US006626513B2

(12) United States Patent
Adkins et al.

(10) Patent No.: US 6,626,513 B2
(45) Date of Patent: Sep. 30, 2003

(54) INK DETECTION CIRCUIT AND SENSOR FOR AN INK JET PRINTER

(75) Inventors: Christopher Alan Adkins, Lexington, KY (US); Adam Jude Ahne, Lexington, KY (US); Michael Clark Campbell, Lexington, KY (US); Mark Joseph Edwards, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/907,710

(22) Filed: Jul. 18, 2001

(65) Prior Publication Data

US 2003/0160837 A1 Aug. 28, 2003

(51) Int. Cl.[7] ..... B41J 29/393
(52) U.S. Cl. ..... 347/19
(58) Field of Search ..... 347/19, 14, 37, 347/23, 30, 35, 7, 8, 6, 10, 71

(56) References Cited

U.S. PATENT DOCUMENTS

| | | | | |
|---|---|---|---|---|
| 2,648,058 | A | 8/1953 | Breedlove | |
| 3,810,194 | A | 5/1974 | Tokunaga et al. | 346/75 |
| 3,852,768 | A | 12/1974 | Carmichael et al. | |
| 3,886,564 | A | 5/1975 | Naylor, III et al. | |
| 4,027,238 | A | 5/1977 | Loch | |
| 4,040,063 | A | 8/1977 | Berglund | 346/23 |
| 4,067,019 | A | 1/1978 | Fleischer et al. | |
| 4,092,591 | A * | 5/1978 | Lozowski | 324/115 |
| 4,121,223 | A | 10/1978 | Omori et al. | |
| 4,196,625 | A | 4/1980 | Kern | |
| 4,202,267 | A | 5/1980 | Heinzl et al. | |
| 4,323,905 | A | 4/1982 | Reitberger et al. | |
| 4,333,083 | A | 6/1982 | Aldridge | |
| 4,426,652 | A | 1/1984 | Horike et al. | |
| 4,509,057 | A | 4/1985 | Sohl et al. | 347/19 |
| 4,737,803 | A | 4/1988 | Fujimura et al. | 346/140 |
| 4,768,045 | A | 8/1988 | Koto | 347/19 |
| 4,788,861 | A | 12/1988 | Lichti | |
| 4,797,688 | A | 1/1989 | Furukawa | 347/6 |
| 4,835,435 | A | 5/1989 | Yeung et al. | |
| 4,872,028 | A | 10/1989 | Lloyd | |
| 4,933,684 | A | 6/1990 | Tasaki et al. | |
| 4,990,932 | A | 2/1991 | Houston | 347/81 |
| 5,036,340 | A | 7/1991 | Osborne | 347/19 |
| 5,070,346 | A | 12/1991 | Mochizuki et al. | |
| 5,107,301 | A | 4/1992 | Yamauchi | |
| 5,160,939 | A | 11/1992 | Bajeux et al. | 347/78 |
| 5,164,747 | A | 11/1992 | Osada et al. | 346/140 |
| 5,223,937 | A | 6/1993 | Moriguchi et al. | |
| 5,289,211 | A | 2/1994 | Morandotti et al. | |
| 5,304,814 | A | 4/1994 | Markham | 250/573 |
| 5,381,099 | A | 1/1995 | Balousek | |
| 5,386,224 | A | 1/1995 | Deur et al. | |
| 5,420,624 | A | 5/1995 | Braun et al. | |
| 5,422,644 | A | 6/1995 | Fast | 341/155 |

(List continued on next page.)

*Primary Examiner*—Steven D. Meier
*Assistant Examiner*—Charles W. Stewart, Jr.
(74) *Attorney, Agent, or Firm*—Taylor & Aust, P.C.

(57) ABSTRACT

An ink detection sensor for an ink jet printer includes two terminals defining a substantially linear gap therebetween. An ink support device supports ink in the gap between the terminals. An electrical measuring device detects a change in an electrical resistance between the terminals when ink is supported in the gap by the ink support device.

17 Claims, 8 Drawing Sheets

U.S. PATENT DOCUMENTS

| | | | | | |
|---|---|---|---|---|---|
| 5,422,664 | A | | 6/1995 | Stephany | |
| 5,508,722 | A | | 4/1996 | Saito et al. | |
| 5,565,786 | A | | 10/1996 | Balousek | |
| 5,583,546 | A | | 12/1996 | Balousek | |
| 5,606,353 | A | | 2/1997 | Mochizuki et al. | |
| 5,646,654 | A | | 7/1997 | Widder | |
| 5,655,174 | A | | 8/1997 | Hirst | |
| 5,682,184 | A | | 10/1997 | Stephany et al. | 347/7 |
| 5,691,750 | A | | 11/1997 | Edwards | |
| 5,710,579 | A | | 1/1998 | Hahs et al. | |
| 5,721,574 | A | * | 2/1998 | Kubby | 347/7 |
| 5,724,076 | A | | 3/1998 | Ishida | |
| 5,739,832 | A | | 4/1998 | Heinzl et al. | 347/68 |
| 5,771,051 | A | | 6/1998 | Guenther et al. | |
| 5,796,414 | A | | 8/1998 | Sievert et al. | 347/19 |
| 5,801,723 | A | | 9/1998 | Balousek | |
| 5,815,175 | A | | 9/1998 | Seikel | 347/23 |
| 5,867,194 | A | | 2/1999 | Clark et al. | |
| 5,914,733 | A | | 6/1999 | Sato et al. | 347/23 |
| 5,929,875 | A | | 7/1999 | Su et al. | |
| 5,936,645 | A | | 8/1999 | Niikura | |
| 5,966,144 | A | | 10/1999 | Edwards | |
| 5,980,030 | A | | 11/1999 | Fujii | 347/85 |
| 5,984,455 | A | | 11/1999 | Anderson | 347/47 |
| 5,992,984 | A | | 11/1999 | Imanaka et al. | 347/65 |
| 5,995,067 | A | | 11/1999 | Terasawa et al. | |
| 6,007,173 | A | | 12/1999 | DeLouise et al. | 347/7 |
| 6,010,201 | A | | 1/2000 | Shimoda | |
| 6,019,450 | A | | 2/2000 | Mochizuki et al. | |
| 6,039,429 | A | | 3/2000 | Balousek | |
| 6,045,210 | A | | 4/2000 | Suzuki et al. | |
| 6,062,668 | A | | 5/2000 | Cruz-Uribe | 347/19 |
| 6,106,089 | A | | 8/2000 | Wen et al. | 346/7 |
| 6,108,089 | A | | 8/2000 | Shiraishi | 347/7 |
| 6,250,735 | B1 | | 6/2001 | Kaneko et al. | 347/19 |
| 6,299,275 | B1 | | 10/2001 | Elgee | 347/19 |
| 6,378,978 | B1 | | 4/2002 | Chang et al. | 347/19 |
| 6,398,334 | B2 | | 6/2002 | Dunand | 347/14 |

* cited by examiner

INK DETECTION CIRCUIT AND SENSOR FOR AN INK JET PRINTER

BACKGROUND OF THE INVENTION

1. Field of the Invention

The present invention relates to ink jet printers, and, more particularly, to an ink sensor for an ink jet printer.

2. Description of the Related Art

Occasionally, under error conditions such as a paper jam or the like, an ink jet printer may print on the platen. Another cause of printing on the platen is using paper that is too narrow for the print job. This is a very detrimental situation, because the ink on the platen becomes very gummy, and contributes to future paper jams, ink smear on the back side of subsequent pages, degraded roller performance, head-to-paper gap problems, etc.

The presence of paper is generally sensed when it enters the nip of the pinch roller just before the paper enters the print zone. Sometimes, paper will jam at this point, such that the printer senses paper present, but no paper is actually in the print zone. Presently, ink jet printers do not have a means to detect that ink is then printing on the platen.

What is needed in the art is a simple, low-cost device for sensing the jetting of ink droplets within an ink jet printer.

Present-day ink jet printers with disposable printheads often continue to function even when the printhead cartridge or bottle has been depleted of ink. This is because they do not have a means to accurately monitor ink usage and accurately detect when ink is depleted. This requires that a user rerun a job if the ink has run dry during his job. For a long job this a severe nuisance.

Many schemes exist in the prior art to sense ink out. These schemes meet with varying degrees of functionality and accuracy. One example is a dot-counting scheme wherein ink usage and an "ink-out" point is estimated based on the dot count. Another scheme uses an optical sensor and a clear ink bottle to "view" the ink level in a special cavity of the bottle. Another method relies on the back pressure of a collapsed lung internal to the bottle. There are also capacitive, resistive, carrier mass measurement and many other types of sensing ink level. Among the disadvantages of the prior art sensors are that they are expensive, they are inaccurate, or they disable the printhead with an amount of ink still in the head.

What is needed in the art is a simple, low-cost, accurate device for sensing when an inkjet printhead has run dry.

There is an optimal operating point for ink jet printheads such that when they are operated at too low a supply voltage they do not jet, but when they are operated at too high a supply voltage they will suffer reduced life. Optimally, it is desired to operate the printhead at voltage just above that required to begin jetting the nozzles, i.e., the point of nucleation. Ideally, it is desired to automatically detect this point for an individual printer, as this voltage varies from printer to printer due to component tolerances, environmental factors, etc. Thus autonucleation detection is a desired function for an inkjet printer.

Schemes exist in the prior art to detect printhead nucleation voltage. One example is a printhead temperature sensing scheme wherein the voltage is stepped up repeatedly, and the printhead temperature is monitored. The temperature increases with the voltage until nucleation, after which there is a detectable fall in temperature for a given fire voltage because energy and therefore heat is being carried away from the head with the fired ink droplets. Thus, the nucleation voltage is inferred from the inflection point of a plot of temperature versus voltage.

A second scheme involves setting a voltage, printing a pattern on a page, and sensing with an optical sensor whether the pattern actually printed. If not, the voltage is stepped up, the pattern is printed, optical sensing is performed, etc, and this process is repeated until the printed pattern is sensed, indicating that the nucleation voltage has been reached.

Among the disadvantages of the prior art schemes are that they are generally expensive and complex, requiring optical or temperature sensing, and perhaps requiring printing of a test page, etc. Also, the determination of the inflection point of the temperature versus voltage plot is prone to inaccuracies, as the inflection is a subtle one and the system is prone to noise.

What is needed in the art is a simple, low-cost, accurate device for detecting autonucleation.

SUMMARY OF THE INVENTION

The present invention provides a simple, low-cost sensor apparatus that can detect whether ink droplets are being jetted within an ink jet printer, and whether the ink drops are being jetted in a certain area of the printer, such as on the platen.

The present invention also provides a device for sensing when an inkjet printhead has run dry, and pausing a job at the page on which the head runs dry, and allowing the user to replace the head cartridge. The job is then resumed such that the driver reruns the last page and completes the job.

The present invention further provides a low-cost, simple device that can detect when autonucleation has taken place in an ink jet printer.

The invention comprises, in one form thereof, an ink detection sensor for an ink jet printer. Two terminals define a substantially linear gap therebetween. An ink support device supports ink in the gap between the terminals. An electrical measuring device detects a change in an electrical resistance between the terminals when ink is supported in the gap by the ink support device.

The invention comprises, in another form thereof, a method of operating an ink jet printer, including monitoring whether ink is impinging upon a platen of the ink jet printer. A print job is stopped if it is detected that ink is impinging upon the platen.

An advantage of the present invention is that it can be determined whether ink is being jetted onto a platen of an ink jet printer.

Another advantage is that the cost of the sensor is much less than that of a reflective, optical type sensor. The sensing circuit requires just a few low cost components.

Yet another advantage is that no special alignment of the sensor in the printer is required. This allows ease of printer manufacturing assembly.

A further advantage is that it can be determined whether an ink jet printer is out of ink.

A still further advantage is that autonucleation of ink within an ink jet printer can be detected.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
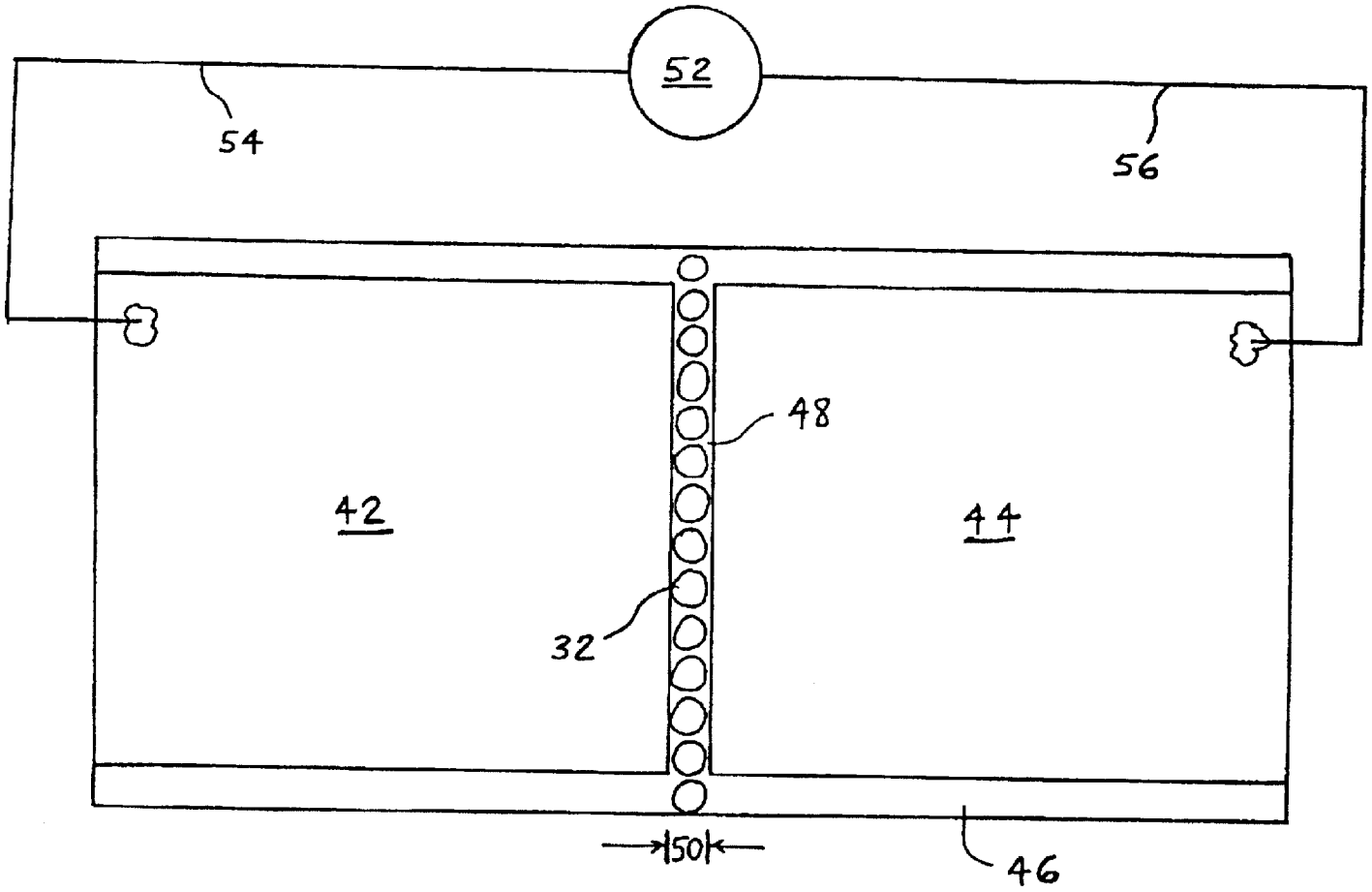
FIG. 1 is an overhead schematic view of one embodiment of a slotted sensor of the present invention.

Referring now to the drawings and particularly to FIG. 1, there is shown one embodiment of a slotted sensor 40 of the present invention, including two copper terminals 42, 44 on a mylar substrate 46. Terminals 42, 44 are separated by a gap 48 having a width 50 of approximately 1/600-inch, which is approximately the width of an ink droplet 32. Gap 48 can be formed by laser cutting. An ohmmeter 52 has leads 54, 56 connected to terminals 42, 44, respectively, to measure the resistance therebetween. When no ink drops 32 are between terminals 42 and 44, the resistance between terminals 42 and 44 is many hundreds of megohms. If a single column of ink dots 32 is printed from printhead 34 into gap 48, as illustrated in FIG. 1, the resistance between terminals 42, 44 drops into the range of approximately between 0.5 and 3 megohms. Printing this column of ink drops 32 even one print element (pel) off-center of gap 48 leaves the resistance between terminals 42, 44 at several hundred megohms. One pel is defined herein as the width of one ink droplet. Once printed in gap 48, the ink evaporates within a few seconds, and the resistance returns to several hundred megohms. Thus, slotted sensor 40 is re-usable, i.e., gap 48 may receive several print "sprays".

Figure 2:
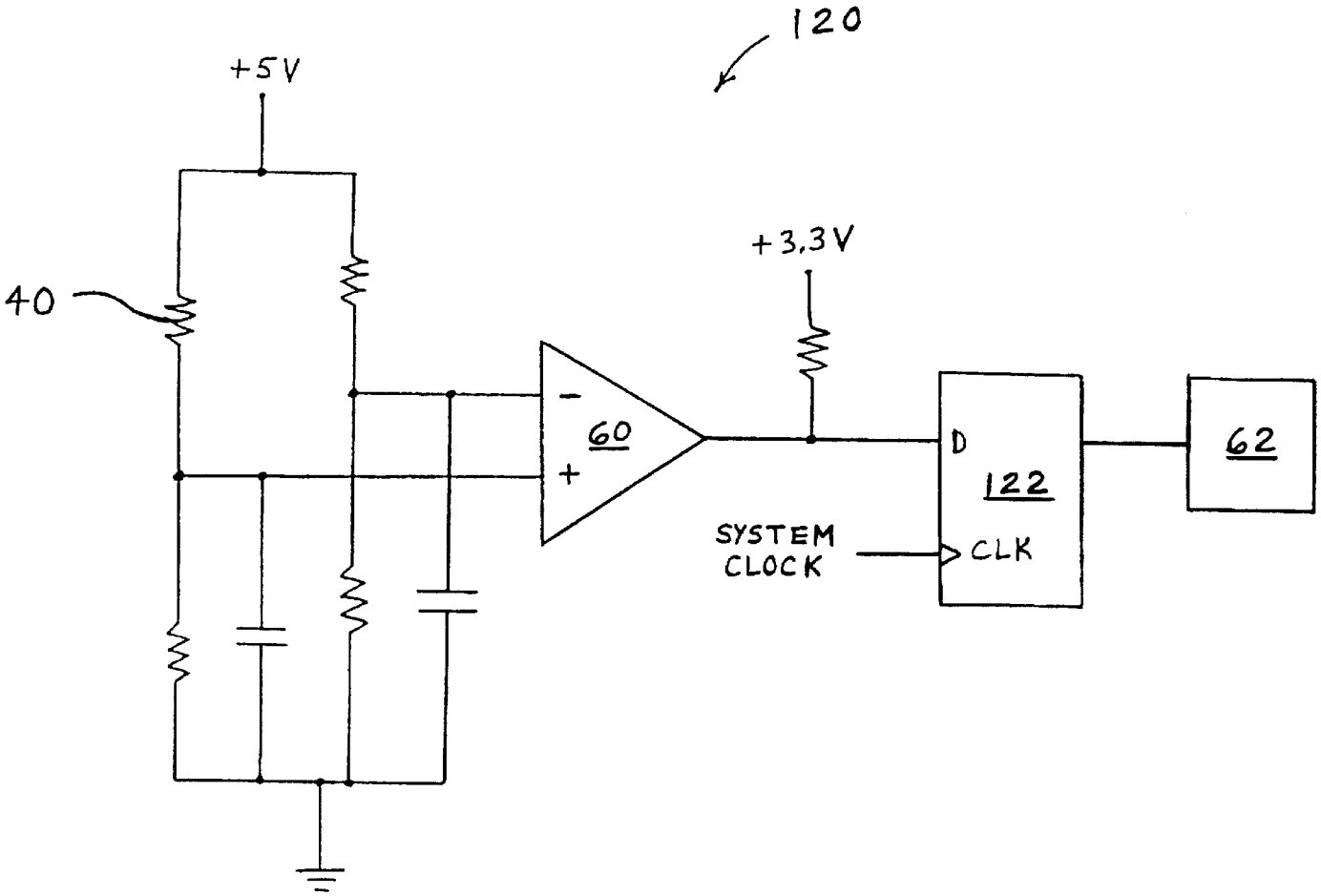
FIG. 2 is a schematic view of one embodiment of a sensing circuit in which the sensor of FIG. 1 can be incorporated.

Slotted sensor 40 can be incorporated in a sensing circuit 120, as shown in FIG. 2. The resistance of sensor 40 is used in a resistor divider in a comparator circuit such that its change from several hundred megohms to just a few megohms causes the output of comparator 60 to go high, which is translated into a positive digital pulse that is sent to an input of a latch 122. Latch 122 drives an interrupt to printer application specific integrated circuit (ASIC) 62 to indicate that the printed dot column has been printed in gap 48 of sensor 40.

Figure 3:
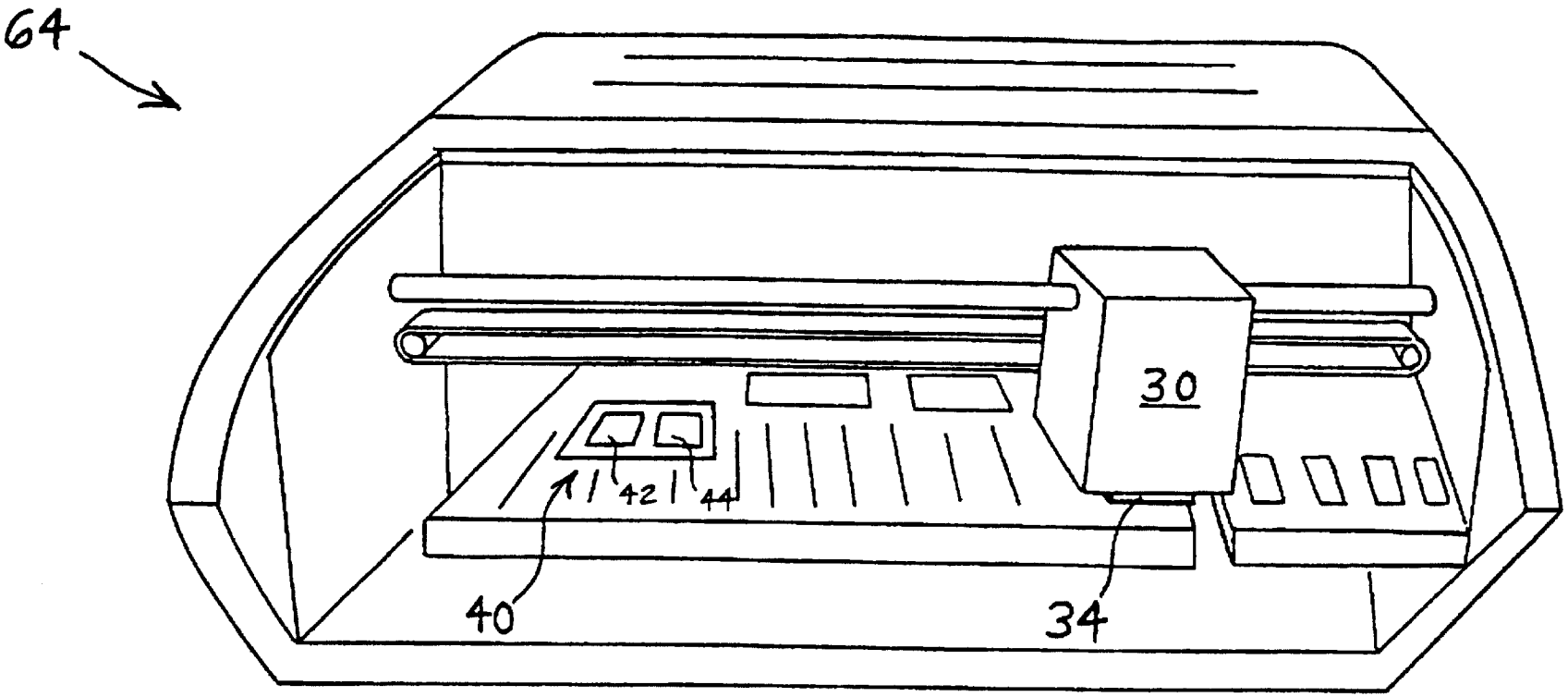
FIG. 3 is a front, sectional, perspective view of an ink jet printer including the sensing circuit of FIG. 2.

One embodiment of the print-on-platen detection method of the present invention includes positioning at least one sensor 40 in the horizontal print path of carrier 30 (FIG. 3) within ink jet printer 64. Any time ink is sprayed or jetted into gap 48 of one or more of sensors 40, the output of comparator 60 flips and latch 122 is triggered. The latch output is connected to a processor interrupt of ASIC 62. At the interrupt, the firmware stops the print job and indicates an error to the user.

Figure 4:
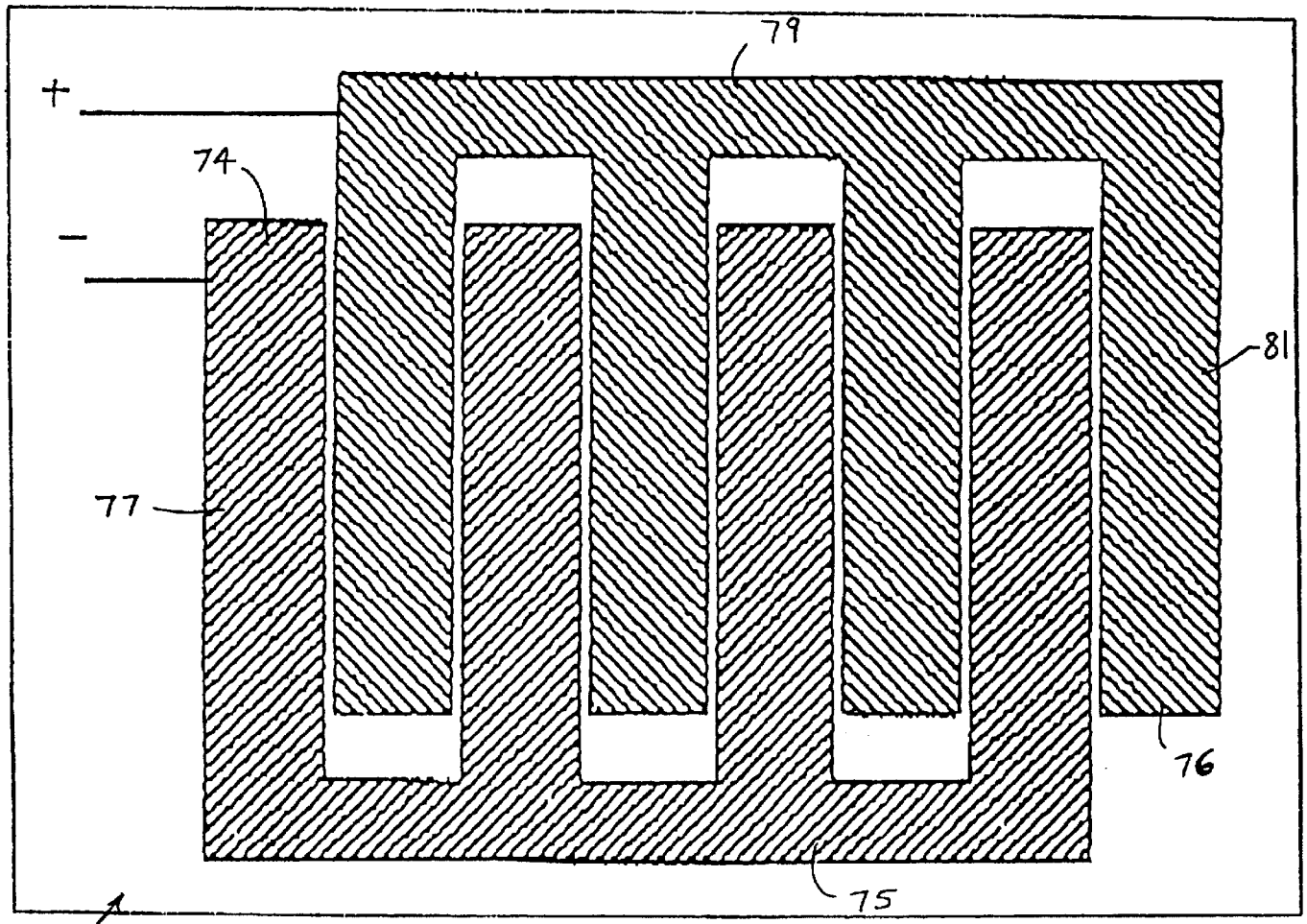
FIG. 4 is an overhead schematic view of another embodiment of a slotted sensor of the present invention.

In another embodiment, a redundant sensor 72 (FIG. 4) operates similarly to sensor 40. Terminal 74 includes a base 75 with tines 77 extending therefrom. Similarly, terminal 76 includes a base 79 with tines 81 extending therefrom. The resistance between terminals 74 and 76 is reduced when a dot column is aligned in a gap therebetween. The method used in conjunction with sensor 72 is similar to that described above except that multiple columns are printed on each pass.

Figure 5:
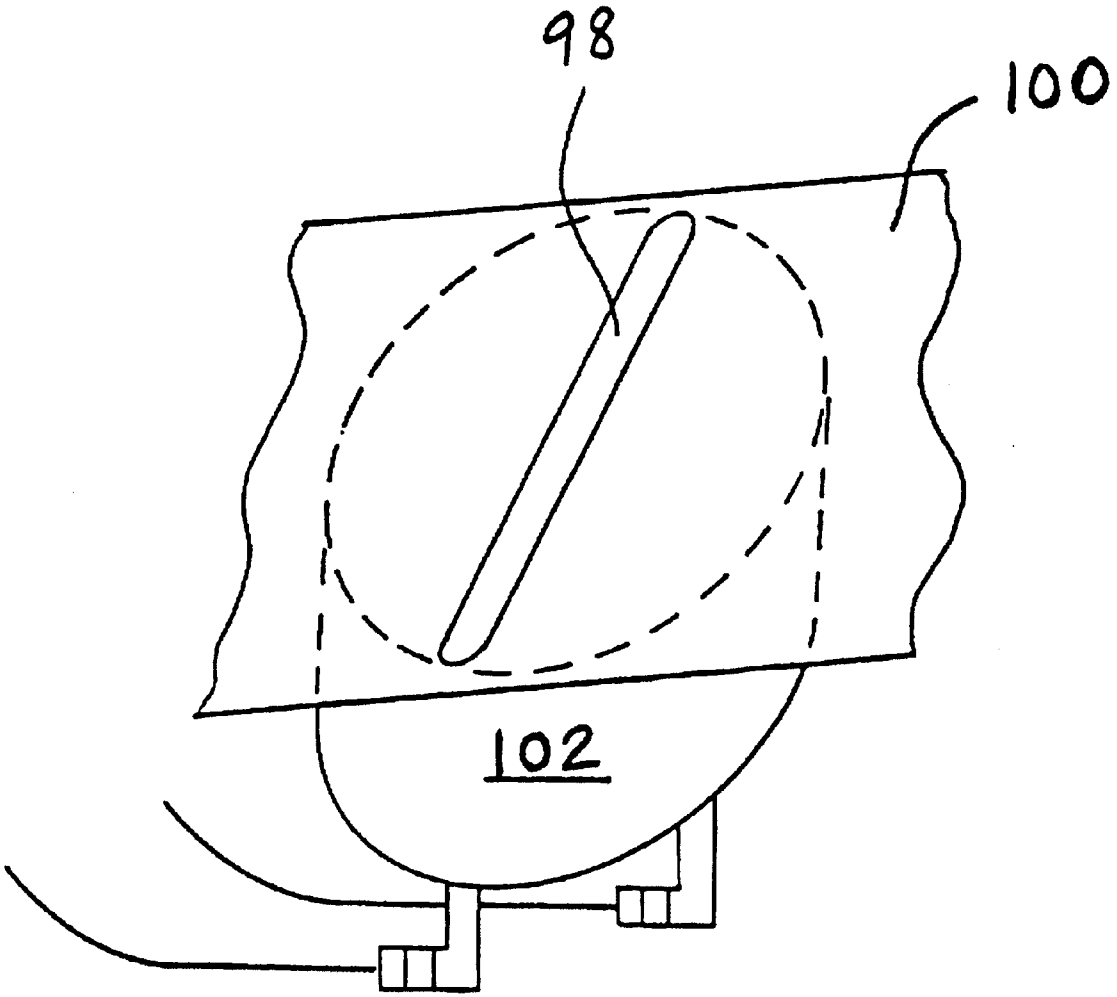
FIG. 5 is an overhead view of yet another embodiment of a slotted sensor of the present invention.

In yet another embodiment (FIG. 5), a one-pel-wide slot or opening 98 is provided in a platen 100 over a sensor 102. Thus, platen 100 functions as a mask. Sensor 102 may be pressure sensitive, vibration sensitive, or a humidity sensor. When a one-pel-wide printed column of ink drops is printed through slot 98 and impinges upon sensor 102, the print position in the x-direction is known. This detection device is reusable.

Figure 6:
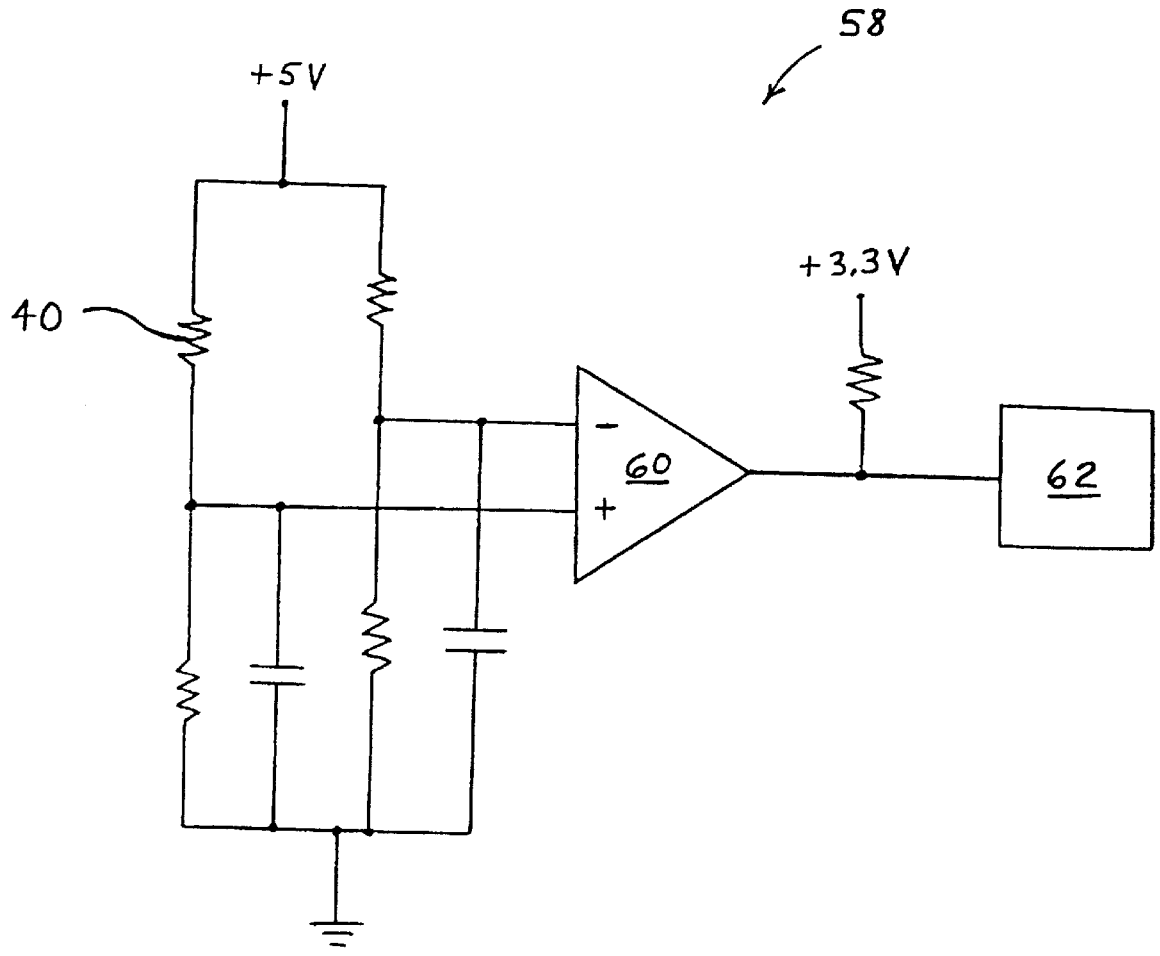
FIG. 6 is a schematic view of one embodiment of a sensing circuit in which the sensor of FIG. 1 can be incorporated.

Another embodiment of a sensing circuit 58 is shown in FIG. 6. A change in resistance in sensor 40 from several hundred megohms to just a few megohms is translated into a positive digital pulse that is sent to printer application specific integrated circuit (ASIC) 62 to indicate when a column of ink dots has been printed in gap 48 of sensor 40.

One embodiment of an ink-out detection method of the present invention includes positioning at least one sensor 40 in the horizontal print path of carrier 30 within ink jet printer 64. An alignment procedure is performed to locate the placement of gap 48 in sensor 40. Carrier 30 is positioned at the approximate position of gap 48, and columns of ink dots are sequentially sprayed at sensor 40 such that each pass shifts the column of printed dots by one pel closer to gap 48 until sensor 40 detects the presence of the dot column.

Dot counting or another form of rough gauging is performed until the ink is determined to be at the last 10% of its expected page count. Rough gauging is used for the majority of the cartridge life to minimize the need for cleaning sensor 40. During the last 10% of the life of printhead 34, after each printed page, printer 64 positions printhead 34 over gapped sensor 40, sprays a column of dots, and determines the presence or absence of ink. When the ink spray is no longer sensed, the job is paused, and the user is alerted to the ink-out condition. The user may replace the cartridge, after which the page may be reprinted and the job completed.

Figure 7:
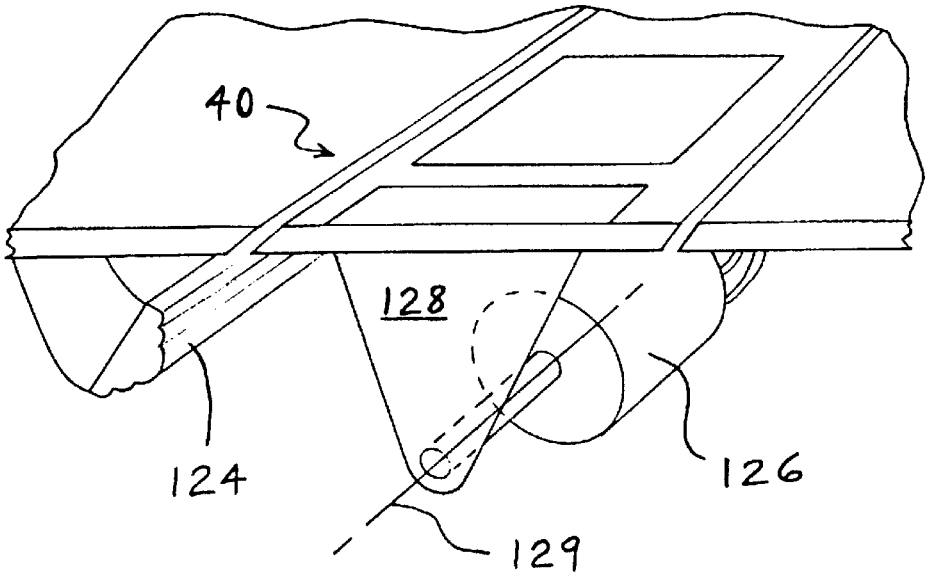
FIG. 7 is a sectional, perspective view of a sensor cleaning mechanism of the printer of FIG. 3.

Periodically, sensor 40 is automatically wiped with a cleaning pad 124 (FIG. 7) in order to remove ink therefrom. A motor 126 pivots a flange 128 about axis 129 such that sensor 40 is wiped across pad 124, and motor 126 then pivots sensor 40 back to its original position.

The ink-out detection method described above can also be performed using sensor 72 or sensor 102.

One embodiment of an autonucleation detection method of the present invention includes positioning at least one sensor 40 in the horizontal print path of carrier 30 within ink jet printer 64. An alignment procedure is performed to locate the placement of gap 48 in sensor 40. Carrier 30 is positioned at the approximate position of gap 48, and columns of ink dots are sequentially sprayed at sensor 40 such that each pass shifts the column of printed dots by one pel closer to gap 48 until sensor 40 detects the presence of the dot column.

Printhead 34 is positioned over gap 48 in sensor 40. The printhead voltage is set to a value below the range that would jet the nozzles. An attempt is then made to fire a column of ink dots from printhead 34 onto gap sensor 40. The printhead voltage is then repetitively stepped up to the next incremental value through the range that would jet the nozzles. At each increment, printhead 34 is fired in an attempt to jet a column of ink dots onto gap sensor 40.

When the ink spray is sensed by sensor 40, nucleation has been detected. The voltage may be incremented a few more steps to provide a reasonable safety margin. At this point, the printhead voltage is optimally set to be as low as possible to still fire reliably, which results in the longest possible printhead life.

Figure 8:
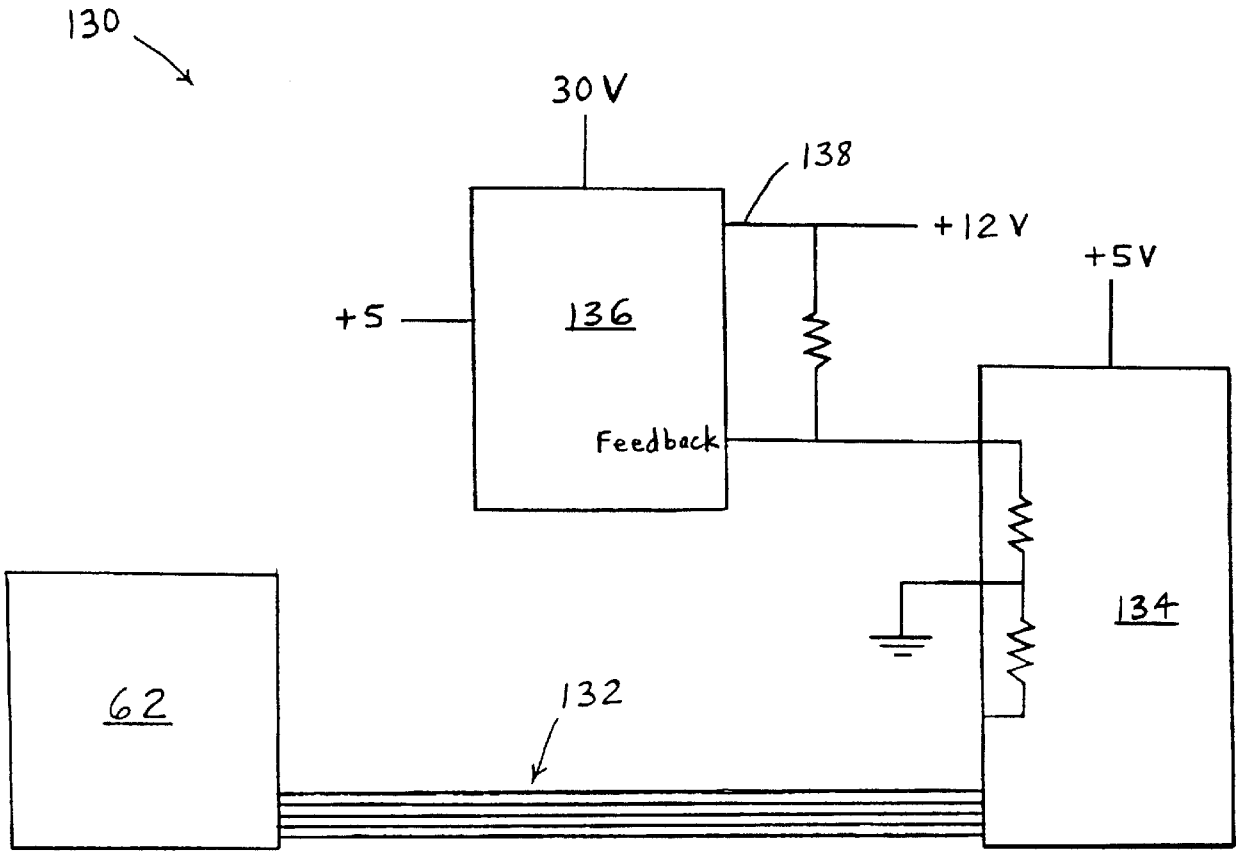
FIG. 8 is a schematic diagram of one embodiment of a printhead voltage adjustment circuit of the present invention.

One embodiment of a circuit 130 for adjusting the printhead voltage under firmware/processor control is shown in FIG. 8. Circuit 130 includes a digital resistance selection bus 132, a digital potentiometer 134 and a printhead voltage regulator 136. Regulator 136 has an output 138 that is nominally 12 volts, but which can be varied between 10 volts and 14 volts.

The autonucleation detection method described above can also be performed using sensor 72 or sensor 102.

Cabling and connectors of the sensor of the present invention are simplified and cost-reduced as compared to an optical sensor because the sensor has only two terminals. The sensor base is small and can be made many-up with standard flex-cable manufacturing methods, then processed through a laser cut process to make the slot.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of sensing an out-of-ink condition in an ink jet printer, said method comprising the steps of:

providing an ink detector having two conductive terminals separated by a gap;

attempting to jet ink into the gap between said terminals of said ink detector; and measuring a resistance between said terminals after said attempting step.

2. The method of claim 1, comprising the further step of placing said ink detector in a horizontal print path of a carrier.

3. The method of claim 1, comprising the further steps of:

determining a location of the gap of the ink detector; and moving a carrier of a printhead to the location of the gap before said attempting step.

4. The method of claim 3, wherein said determining step includes the substeps of:

jetting a plurality of aligned ink drops from the printhead when said carrier is at a jetting location, the aligned ink drops being substantially parallel to said gap;

sensing whether at least one of said ink drops has been jetted into said gap;

repeating said jetting and sensing steps until at least one of said ink drops has been jetted into said gap, each said jetting location being closer to said gap than an immediately preceding said jetting location; and recording a reference location of said carrier, said reference location being a location of said carrier when it is sensed that at least one of said ink drops has been jetted into said gap.

5. The method of claim 4, wherein said sensing step includes measuring an electrical resistance between said terminals.

6. The method of claim 1, comprising the further steps of:

allowing said ink jetted into said gap to at least one of dry and evaporate; and repeating said attempting and measuring steps.

7. The method of claim 1, comprising the further step of estimating that a threshold amount of ink remains in the printer, said estimating step occurring before said attempting and measuring steps.

8. The method of claim 1, comprising the further step of alerting a user to the out-of-ink condition.

9. The method of claim 1, comprising the further step of periodically wiping the ink off of said ink detector.

10. A method of sensing nucleation of ink in an ink jet printer, said method comprising the steps of:

providing an ink detector having two conductive terminals separated by a gap;

attempting to jet ink into the gap between said terminals of said ink detector; and measuring a resistance between said terminals after said attempting step.

11. The method of claim 10, comprising the further step of placing said ink detector in a horizontal print path of a carrier.

12. The method of claim 10, comprising the further steps of:

determining a location of the gap of the ink detector; and moving a carrier of a printhead to the location of the gap before said attempting step.

13. The method of claim 12, wherein said determining step includes the substeps of:

jetting a plurality of aligned ink drops from the printhead when said carrier is at a jetting location, the aligned ink drops being substantially parallel to said gap;

sensing whether at least one of said ink drops has been jetted into said gap;

repeating said jetting and sensing steps until at least one of said ink drops has been jetted into said gap, each said jetting location being closer to said gap than an immediately preceding said jetting location; and recording a reference location of said carrier, said reference location being a location of said carrier when it is sensed that at least one of said ink drops has been jetted into said gap.

14. The method of claim 13, wherein said sensing step includes measuring an electrical resistance between said terminals.

15. The method of claim 10, comprising the further steps of:

allowing said ink jetted into said gap to at least one of dry and evaporate; and repeating said attempting and measuring steps.

16. The method of claim 10, wherein said attempting step is performed with an initial printhead voltage, said initial printhead voltage being below a minimum voltage required to allow the nucleation of the ink, said method comprising the further steps of:

repeating said attempting and measuring steps until a reduction in said resistance between said terminals is measured, each said attempting step being performed with a higher printhead voltage than an immediately preceding said printhead voltage; and recording a reference printhead voltage, said reference printhead voltage being a printhead voltage at which said reduction in said resistance between said terminals was measured.

17. The method of claim 16, comprising the further step of repeating said attempting and measuring steps at least once after said reduction in said resistance between said terminals was measured, each said attempting step being performed with a higher printhead voltage than an immediately preceding said printhead voltage.

* * * * *